US012799399B2

(12) United States Patent
Chu et al.

(10) Patent No.: US 12,799,399 B2
(45) Date of Patent: Nov. 17, 2026

(54) COKING SYSTEM AND COKING PROCESS

(71) Applicants: CHINA PETROLEUM & CHEMICAL CORPORATION, Beijing (CN); DALIAN RESEARCH INSTITUTE OF PETROLEUM AND PETROCHEMICALS, SINOPEC CORP., Dalian (CN)

(72) Inventors: Renqing Chu, Dalian (CN); Xiangchen Fang, Dalian (CN); Dan Guo, Dalian (CN); Yongyi Song, Dalian (CN); Jihua Liu, Dalian (CN); Lianzhong Gou, Dalian (CN); Dewei Jiao, Dalian (CN); Yun Wu, Dalian (CN)

(73) Assignees: CHINA PETROLEUM & CHEMICAL CORPORATION, Beijing (CN); DALIAN RESEARCH INSTITUTE OF PETROLEUM AND PETROCHEMICALS, SINOPEC CORP., Dalian (CN)

( * ) Notice: Subject to any disclaimer, the term of this patent is extended or adjusted under 35 U.S.C. 154(b) by 578 days.

(21) Appl. No.: 18/315,192

(22) Filed: May 10, 2023

(65) Prior Publication Data

US 2023/0272284 A1 Aug. 31, 2023

Related U.S. Application Data

(62) Division of application No. 16/763,913, filed as application No. PCT/CN2018/115326 on Nov. 14, 2018, now abandoned.

(30) Foreign Application Priority Data

Nov. 14, 2017 (CN) ..... 201711119034.2

(51) Int. Cl.
*C10B 55/00* (2006.01)
*C10B 1/04* (2006.01)
(Continued)

(52) U.S. Cl.
CPC ..... *C10B 57/02* (2013.01); *C10B 1/04* (2013.01); *C10B 55/00* (2013.01); *C10B 55/04* (2013.01); *C10B 57/045* (2013.01)

(58) Field of Classification Search
CPC ..... C10B 55/00; C10B 55/02
See application file for complete search history.

(56) References Cited

U.S. PATENT DOCUMENTS 3,109,803 A * 11/1963 Bloomer ..... C10B 55/00 208/417
3,375,188 A 3/1968 Bloomer
(Continued)

FOREIGN PATENT DOCUMENTS

CN 87102308 A 10/1988
CN 1325938 A 12/2001
(Continued)

OTHER PUBLICATIONS

Examiner; "Notice of Final Rejection for Application No. 10-2020-7017162"; Korean Intellectual property Office; Nov. 29, 2023; pp. 1-5.

*Primary Examiner* — Jonathan Luke Pilcher
(74) *Attorney, Agent, or Firm* — NKL Law; Allen Xue

(57) ABSTRACT

A coking system comprises the 1st to the m-th heating units and the 1st to the n-th coke towers, each of the m heating units being in communication with the n coke towers, respectively, each of the n coke towers being in communication with one or more separation towers, respectively, in communication with the m-th heating unit and optionally with the i-th heating unit. The coking system can at least
(Continued)

utilize petroleum series or coal series raw materials to produce high-quality needle coke with stable performance.

16 Claims, 1 Drawing Sheet

(51) Int. Cl.

| | |
|---|---|
| ***C10B 55/04*** | (2006.01) |
| ***C10B 57/02*** | (2006.01) |
| ***C10B 57/04*** | (2006.01) |

(56) References Cited

U.S. PATENT DOCUMENTS

| | | | | |
|---|---|---|---|---|
| 3,472,761 | A | 10/1969 | Cameron | |
| 3,769,200 | A | 10/1973 | Folkins | |
| 3,956,101 | A | 5/1976 | Hara et al. | |
| 4,235,703 | A | 11/1980 | Kegler et al. | |
| 4,518,486 | A | 5/1985 | Jansma | |
| 4,822,479 | A * | 4/1989 | Fu | C10B 57/005 208/50 |
| 4,853,106 | A | 8/1989 | Grove et al. | |
| 4,894,144 | A | 1/1990 | Newman et al. | |
| 4,929,339 | A * | 5/1990 | Elliott, Jr. | C10B 57/005 201/29 |
| 4,983,272 | A | 1/1991 | Stavropoulos | |
| 5,028,311 | A * | 7/1991 | Shigley | C10B 57/045 208/50 |
| 5,034,116 | A * | 7/1991 | Newman | C10B 57/045 208/50 |
| 5,158,668 | A * | 10/1992 | Chahar | C21B 5/007 208/50 |
| 5,389,234 | A | 2/1995 | Bhargava et al. | |
| 5,645,712 | A * | 7/1997 | Roth | C10G 9/005 208/50 |
| RE36,922 | E | 10/2000 | Sparks et al. | |
| 8,361,310 | B2 | 1/2013 | Etter et al. | |
| 9,969,937 | B2 * | 5/2018 | Faegh | C10G 11/18 |
| 2005/0098477 | A1 | 5/2005 | Doerksen | |
| 2012/0298553 | A1 * | 11/2012 | Fern | C10G 51/04 422/68.1 |
| 2014/0082999 | A1 * | 3/2014 | Faegh | C10G 11/18 44/629 |

FOREIGN PATENT DOCUMENTS

| | | | |
|---|---|---|---|
| CN | 101280212 | A | 10/2008 |
| CN | 101302434 | A | 11/2008 |
| CN | 102295943 | A | 12/2011 |
| CN | 103184057 | A | 7/2013 |
| CN | 103805226 | A | 5/2014 |
| CN | 105647552 | A | 6/2016 |
| CN | 105985803 | A | 10/2016 |
| CN | 106675632 | A | 5/2017 |
| CN | 108587661 | A | 9/2018 |
| JP | S5770184 | A | 4/1982 |
| JP | H06504569 | A | 5/1994 |
| JP | 2005523344 | A | 8/2005 |
| RU | 2315079 | C2 | 1/2008 |
| SU | 1214717 | A1 | 2/1986 |
| SU | 1447835 | A1 | 12/1988 |
| SU | 1472480 | A1 | 4/1989 |

* cited by examiner

COKING SYSTEM AND COKING PROCESS

CROSS-REFERENCE TO RELATED APPLICATIONS

This application is a divisional of U.S. patent application Ser. No. 16/763,913, filed May 13, 2020, which is a U.S. national stage entry of PCT International Application No. PCT/CN2018/115326, filed Nov. 14, 2018, which claims the priority to CN 201711119034.2, filed Nov. 14, 2017, the content of each is incorporated herein by reference in its entirety.

TECHNICAL FIELD

The invention relates to a coking system, in particular to a coking system for producing needle coke. The invention also relates to a coking process.

BACKGROUND

The needle coke is mainly used for producing high-power and ultrahigh-power graphite electrodes. With the development of the steel era, the yield of scrap steel is gradually increased, the development of electric furnace steel is promoted, the consumption of graphite electrodes, particularly high-power and ultrahigh-power electrodes, is increased inevitably, and the demand of needle coke is increased continuously.

CN200810017110.3 discloses a method for preparing needle coke, which comprises subjecting aromatic-rich fraction or residual oil to delayed coking treatment under a certain temperature-increasing program, and calcining the obtained green coke to obtain a needle coke with high mesophase content and developed needle structure.

CN201110449286.8 discloses a method for producing homogeneous petroleum needle coke, which comprises the steps of heating a feedstock for producing needle coke to a relatively low temperature of 400-480° C. by a heating furnace, and then feeding the feedstock into a coke tower, wherein the coking feedstock forms a flowable mesophase liquid crystal; after the low-temperature fresh feedstock feeding stage is completed, gradually raising the outlet temperature of the heating furnace, and simultaneously changing the feed of the coker heating furnace into a fresh feedstock and a heavy distillate oil from a fractionation tower; and when the material in the coke tower reaches the temperature for solidifying and coke-forming, changing the feed of the coker heating furnace into a coker middle distillate oil generated in the reaction process, and simultaneously increasing the feeding temperature of the coker heating furnace to ensure that the temperature in the coke tower reaches 460-510° C., and completing the high-temperature solidification of the petroleum coke to obtain a needle coke product.

U.S. Pat. No. 4,235,703 discloses a method for producing high-quality coke from residual oil, which comprises the steps of hydrodesulfurizing and demetallizing the feedstock, and then performing the delayed coking to produce high-power electrode petroleum coke.

U.S. Pat. No. 4,894,144 discloses a process for simultaneously making needle coke and high-sulfur petroleum coke by pretreating straight-run heavy oil by hydrotreating process, and the hydrogenated residual oil is divided into two parts, which are respectively coked and then calcined to obtain needle coke and high-sulfur petroleum coke.

CN1325938A discloses a method for producing a needle-like petroleum coke from a sulfur-containing atmospheric residue, in which the feedstock is sequentially subjected to hydrofining, hydrodemetalization and hydrodesulfurization, the hydrogenated product is separated to obtain a hydrogenated heavy distillate oil, the hydrogenated heavy distillate oil is subjected to a delayed coking to obtain the needle-like coke under the condition of producing the needle-like coke.

The above method adopt a conventional one-furnace and two-tower delayed coking mode to produce the needle coke, which does not solve the problems of large operation fluctuation caused by temperature and pressure change in the needle coke production process, and generally has the problem of unstable needle coke product performance. Therefore, how to produce high-quality needle coke products with uniform performance is a goal pursued by researchers.

SUMMARY OF THE INVENTION

The inventors of the invention have found that in the delayed coking project for producing needle coke in the prior art, the heating unit generally adopts a variable temperature control, and the heating unit circularly carries out the processes of temperature rise, constant temperature, temperature reduction and temperature rise in the production cycle of delayed coking, so that the variable temperature range is wide and the stable operation is difficult; even in some delayed coking processes, the heating unit needs to go through different heating stages to heat different feedstocks, for example, a fresh feedstock, a mixture of the a fresh feedstock and the coker gas oil and a middle distillate oil are heated in different coke-charging stages, the difference of the feeding properties of the heating unit is large, and the control of the pulling/forming ratio (the ratio of the coke-pulling feedstock to the coke-forming feedstock) in different feeding stages is different, which causes a large change in the feeding amount of the heating unit.

Further, the present inventors have found, through many years of studies, that production conditions have an important influence on the performance of needle coke, that small variations in the conditions may affect the formation of streamline texture in the product and the coefficient of thermal expansion, and that the inevitable small errors in the operations such as the temperature change, the pressure change and the changed feeding amount of the heating unit during the above coke-charging process are the major causes of large differences in the quality of the product; and have completed the present invention based on this finding.

Specifically, the present invention relates to the following aspects.

1. A coking system comprising a 1st to a m-th (total m) heating units (preferably heat exchangers or furnaces, more preferably furnaces) and a 1st to a n-th (total n) coke towers, m being any integer from 2 to n-1, n being any integer from 3 or more (preferably any integer from 3 to 20, more preferably any integer from 3 to 5, more preferably 3), each of the m heating units being in communication with the n coke towers, respectively, each of the n coke towers (preferably the upper part and/or the overhead) being in communication with one or more (preferably one) separation towers (preferably rectifying tower, flash tower, evaporation tower or fractionation tower, more preferably fractionation tower), respectively, the one or more separation towers (preferably the lower part and/or the bottom) being in communication with the m-th heating unit and optionally being in communication with an i-th heating unit (i being any integer greater than 1 and less than m) (preferably not being in communication with the 1st heating unit).

2. The coking system of any of the preceding or subsequent aspects, further comprising a control unit configured to enable to start and terminate the material transport from each of heating units to an h-th coke tower sequentially in the order from the 1st heating unit to the m-th heating unit from the time T0, and terminate the material transport from the m-th heating unit to the h-th coke tower at the time Te, assuming T0 is a coke-charging starting time and Te is a coke-charging termination time for the h-th coke tower (h being any integer from 1 to n) of the n coke towers.

3. The coking system of any of the preceding or subsequent aspects, further comprising at least one filtration device disposed at an inlet and/or an outlet of at least one of the heating units (preferably the m-th heating unit, and optionally the i-th heating unit, where i is any integer greater than 1 and less than m).

4. The coking system of any of the preceding or subsequent aspects, further comprising at least one coke-forming feedstock storage tank, wherein the at least one coke-forming feedstock storage tank is in communication with the 1st heating unit and optionally in communication with an i-th heating unit (i being any integer greater than 1 and less than m) (preferably not in communication with the m-th heating unit).

6. A coking process comprises the steps of coking by using m heating units and n coke towers, wherein m is any integer of 2 to n-1, n is any integer of 3 or more (preferably any integer of 3 to 20, more preferably any integer of 3 to 5, more preferably 3), each of the m heating units is respectively communicated with the n coke towers in a material transport manner, assuming T0 is a coke-charging starting time and Te is a coke-charging termination time for the h-th coke tower (h being any integer from 1 to n) of the n coke towers, starting at said time T0, the material transport from each of heating units to the h-th coke tower in the order from said the 1st heating unit to the m-th heating unit is sequentially started and terminated, and at the time Te, the material transport from the m-th heating unit to the h-th coke tower is terminated.

7. The coking process of any of the preceding or subsequent aspects, wherein at the time Te, the sum of the materials transported from the 1st to the m-th heating units to the h-th coke tower is equal to the target coke-charging capacity of the h-th coke tower.

8. The coking process of any of the preceding or subsequent aspects, wherein during a single material transport cycle, each of the 1st to the m-th heating units transports only one batch of material to the h-th coke tower, or at any time during a single material transport cycle, the h-th coke tower either (i) does not accept the transported material or (ii) only accepts the material transported from one of the 1st to the m-th heating units.

9. The coking process of any of the preceding or subsequent aspects, wherein after a material transport cycle is complete, the h-th coke tower is subjected to a purging and decoking operation before either (i) the h-th coke tower is on standby; or (ii) the next material transport cycle is started for the h-th coke tower.

10. The coking process of any of the preceding or subsequent aspects, wherein each of the 1st to the m-th heating units heats its transported material to the temperature required by the h-th coke tower for said transported material.

11. The coking process of any of the preceding or subsequent aspects, wherein the 1st heating unit heats its transported material (referred to as the 1st transported material) to a feeding temperature W1 of from 400° C. to 480° C. (preferably from 420° C. to 460° C.) and the 1st transported material brings the intra-tower gas velocity G1 of the h-th coke tower to from 0.05 to 0.25 m/s (preferably from 0.05 to 0.10 m/s), the m-th heating unit heats its transported material (referred to as the m-th transported material) to a feeding temperature Wm of from 460° C. to 530° C. (preferably from 460° C. to 500° C.) and the m-th transported material brings the intra-tower gas velocity Gm of the h-th coke tower to from 0.10 to 0.30 m/s (preferably from 0.15 to 0.20 m/s), the i-th heating unit (i being any integer greater than 1 and less than m) heats its transported material (referred to the i-th transported material) to a feeding temperature Wi ($W1 \leq Wi \leq Wm$), and the i-th transported material enables the intra-tower gas velocity Gi of the h-th coke tower to reach $G1 \leq Gi \leq Gm$, and/or the heating rate V1 of the transported material by the 1st heating unit is 1-30° C./h (preferably 1-10° C./h), the heating rate Vm of the transported material by the m-th heating unit is 30-150° C./h (preferably 50-100° C./h), and the heating rate Vi of the transported material by the i-th heating unit (i is any integer greater than 1 and less than m) meets the relational expression $V1 \leq Vi \leq Vm$.

12. The coking process of any of the preceding or subsequent aspects, wherein the upper material and/or the overhead material (preferably overhead material) of each of the n coke towers is transferred to one or more (preferably one) separation towers (preferably rectifying tower, flash tower, evaporation tower or fractionation tower, more preferably fractionation tower) and in the one or more separation towers, the material is at least separated into the overhead material of the separation tower and the bottom material of the separation tower.

13. The coking process of any of the preceding or subsequent aspects, wherein the operating conditions of the one or more separation towers include: the pressure at the top of the tower is 0.01-0.8 MPa, the temperature at the top of the tower is 100-200° C., the temperature at the bottom of the tower is 280-400° C., and/or the operating conditions of the n coke towers are identical to or different from each other, and each independently comprises: the pressure at the top of the tower is 0.01-1.0 MPa, the temperature at the top of the tower is 300-470° C., and the temperature at the bottom of the tower is 350-510° C.

14. The coking process of any of the preceding or subsequent aspects, wherein the 1st heating unit has (preferably only) a coke-forming feedstock as its transported material, the m-th heating unit has (preferably only) a coke-pulling feedstock as its transported material (preferably at least comprising the bottom material of the separation tower), and the i-th heating unit (i being any integer greater than 1 and less than m) has at least one selected from the group consisting of the coke-forming feedstock and the coke-pulling feedstock as its transported material.

15. The coking process of any of the preceding or subsequent aspects, wherein the coke-forming feedstock is selected from at least one of a coal-based feedstock and a petroleum-based feedstock (preferably the sulfur content <0.6 wt %, more preferably <0.5 wt %, and the colloid/asphaltene content <10.0 wt %, preferably <5.0 wt %, more preferably <2.0 wt %), preferably from at least one of coal tar, coal tar pitch, petroleum heavy oil, ethylene tar, catalytic cracking residue or thermal cracking residue, and has a coke formation rate (referred to as coke formation rate A) of 10 to 80% (preferably 20 to 70%, more preferably 30 to 60%), and/or the bottom material of the separation tower has a 10% distillate point temperature of 300° C. to 400° C. (preferably 350° C. to 380° C.), a 90% distillate point temperature of 450° C. to 500° C. (preferably 460° C. to 480° C.), and/or the coke-pulling feedstock is selected from at least one of a coal-based feedstock and a petroleum-based feedstock (preferably selected from coker gas oil, coker diesel, ethylene tar, and thermally cracked heavy oil, more preferably sulfur content <1.0 wt %, more preferably <0.6 wt %), and has a coke formation rate (referred to as coke formation rate B) is 1-40% (preferably 1-20%, more preferably 1-10%), provided that the coke formation rate A>the coke formation rate B.

16. The coking process of any of the preceding or subsequent aspects, wherein the weight ratio of the total amount of the coke-pulling feedstock to the total amount of the coke-forming feedstock transported to the h-th coke tower (h being any integer from 1 to n) during one material transport cycle is from 0.5 to 4.0 (preferably from 1.0 to 2.0).

17. The coking process of any of the preceding or subsequent aspects, wherein assuming Te−T0=T, the h-th coke tower has a coke-charging cycle T of from 10 to 60 hours (preferably from 24 to 48 hours), or the n coke towers have coke-charging cycles T that are identical to or different from each other (preferably identical to each other), and separately and independently from 10 to 60 hours (preferably from 24 to 48 hours).

18. The coking process of any of the preceding or subsequent aspects, wherein within one material transport cycle, assuming that one material transport cycle is TC (in hours) and that the material transport times of the 1st to the m-th heating units to the h-th coke tower are D1 to Dm, respectively (in hours), then D1/TC=10-90% or 30-70%, D2/TC=10-90% or 30-70%, . . . , Dm/TC=10-90% or 30-70%, and TC/2≤D1+D2+ . . . +Dm≤TC (preferably D1+D2+ . . . +Dm=TC), or, D1=D2= . . . =Dm=TC/m=T/m, and D1+D2+ . . . +Dm=TC=T, where T is the coke-charging cycle of the h-th coke tower.

19. The coking process of any of the preceding or subsequent aspects, wherein assuming that any two of the n coke towers that are numbered adjacent (number 1 and number n are defined as being numbered adjacent) are the a-th coke tower and the b-th coke tower, respectively (where a is any integer from 1 to n and b is any integer from 1 to n, but a b), then at the time that the material transport from the j-th heating unit (j being any integer from 1 to m) to the a-th coke tower is terminated, the material transport from the j-th heating unit to the b-th coke tower is started.

20. The coking process of any of the preceding or subsequent aspects, wherein at least one material selected from the group consisting of the coke-forming feedstock and the coke-pulling feedstock (preferably the coke-pulling feedstock, more preferably the bottom material of the separation tower) is filtered before entering a heating unit and/or before entering a coke tower (preferably before entering a heating unit, more preferably before entering the m-th heating unit, and optionally before entering the i-th heating unit, wherein i is any integer greater than 1 and less than m), thereby controlling the coke fine particle concentration of the material to be in the range of 0 to 200 mg/L (preferably 0 to 100 mg/L, more preferably 0 to 50 mg/L).

21. The coking process of any of the preceding or subsequent aspects, wherein at least a portion (such as 10 wt % or more, 20 wt % or more, 30 wt % or more, 40 wt % or more, 50 wt % or more, 60 wt % or more, 70 wt % or more, 80 wt % or more, 90 wt % or more, or 100 wt %) of the upper material and/or the overhead material (preferably overhead material) of each of the n coke towers is transferred to one or more (preferably one) separation towers (preferably rectifying tower, flash tower, evaporation tower or fractionation tower, more preferably fractionation tower) and at least a portion (such as 10 wt % or more, 20 wt % or more, 30 wt % or more, 40 wt % or more, 50 wt % or more, 60 wt % or more, 70 wt % or more, 80 wt % or more, 90 wt % or more, or 100 wt %) of the lower material and/or the bottom material of the one or more separation towers is transported to the m-th heating unit and optionally to the i-th heating unit (i being any integer greater than 1 and less than m), preferably not transported to the 1st heating unit.

22. The coking process of any of the preceding or subsequent aspects, wherein assuming m=2, n=3, 3 coke towers are respectively marked as coke tower a, coke tower b and coke tower c, and 2 heating units are respectively marked as heating unit a and heating unit b, the overhead material (oil gas) of each of the 3 coke towers is in communication with one of the separation towers in a material transport manner, the heating unit a transports and heats a coke-forming feedstock, and the heating unit b transports and heats a coke-pulling feedstock, the coking process comprises at least the steps of:

(1) Feeding the coke-forming feedstock into the coke tower a, and introducing the oil gas generated by the coke tower a into the separation tower to separate off at least coker gas oil;

(2) When the feeding duration of the coke tower a reaches 30-70% (preferably about 50%) of the coke-charging cycle T of the coke tower a, stopping feeding the coke-forming feedstock to the coke tower a, simultaneously starting to feed the coke-forming feedstock to the coke tower b and starting to feed the coke-pulling feedstock to the coke tower a, and feeding the oil gas generated by the coke tower b to the separation tower to separate off at least coker gas oil;

(3) When the feeding duration of the coke tower b reaches 30-70% (preferably about 50%) of the coke-charging cycle T of the coke tower b, stopping feeding the coke-forming feedstock to the coke tower b, simultaneously starting to feed the coke-forming feedstock to the coke tower c, starting to feed the coke-pulling feedstock to the coke tower b, and stopping feeding the coke-pulling feedstock to the coke tower a, and feeding the oil gas generated by the coke tower c to the separation tower to separate off at least coker gas oil;

(4) Performing steam purging and decoking operations on the coke tower a;

(5) When the feeding duration of the coke tower c reaches 30-70% (preferably about 50%) of the coke-charging cycle T of the coke tower c, stopping feeding the coke-forming feedstock to the coke tower c, simultaneously starting to feed the coke-forming feedstock to the coke tower a, starting to feed the coke-pulling feedstock to the coke tower c and stopping feeding the coke-pulling feedstock to the coke tower b, and feeding the oil gas generated by the coke tower a to the separation tower to separate off at least coker gas oil;

(6) Performing steam purging and decoking operations on the coke tower b;

(7) When the feeding duration of the coke tower a reaches 30-70% (preferably about 50%) of the coke-charging cycle T of the coke tower a, stopping feeding the coke-forming feedstock to the coke tower a, and simultaneously starting to feed the coke-forming feedstock to the coke tower b, starting to feed the coke-pulling feedstock to the coke tower a and stopping feeding the coke-pulling feedstock to the coke tower c, and feeding the oil gas generated by the coke tower b to the separation tower to separate off at least coker gas oil;

(8) Performing steam purging and decoking operations on the coke tower c; and (9) Repeating the steps (3) to (8).

23. A coking system, which comprises three coke towers, two sets of heating furnaces, a fractionation tower and a coke-pulling feedstock storage tank, wherein the three coke towers are respectively marked as a coke tower a, a coke tower b and a coke tower c; the two sets of heating furnaces are respectively marked as a heating furnace a and a heating furnace b, any coke tower is connected with the two sets of heating furnaces, the top of any coke tower is connected with the inlet of a fractionation tower via pipeline, the bottom outlet of the fractionation tower is connected with a coke-pulling feedstock storage tank, the coke-pulling feedstock storage tank is connected with the heating furnace b and heats the material from the coke-pulling feedstock storage tank to the feeding temperature of the coke tower, and the heating furnace a is connected with the feedstock tank and heats the coking feedstock to the feeding temperature of the coke tower.

24. The coking system of any preceding aspect in which a filtration device is provided between the coke-pulling feedstock storage tank and the heating furnace b.

25. A coking process, in which a coking device is used and comprises three coke towers, two sets of heating furnaces, a fractionation tower and a coke-pulling feedstock storage tank, wherein the three coke towers are respectively marked as a coke tower a, a coke tower b and a coke tower c; the two sets of heating furnaces are respectively marked as a heating furnace a and a heating furnace b, any coke tower is connected with the two sets of heating furnaces, the top of any coke tower is connected with the inlet of the fractionation tower via pipeline, the bottom outlet of the fractionation tower is connected with the coke-pulling feedstock storage tank, the heating furnace b is connected with the coke-pulling feedstock storage tank and is used for heating the material from the coke-pulling feedstock storage tank to the feeding temperature of the coke tower, and the heating furnace a is connected with the feedstock tank and is used for heating a fresh feedstock to the feeding temperature of the coke tower;

The specific operation process is as follows:

(1) The coking feedstock is heated by the heating furnace a and enters the coke tower a, the generated oil gas enters the fractionation tower and is fractionated to obtain gas, coker gasoline, coker diesel and coker gas oil at the tower bottom, wherein the coker gas oil at the tower bottom is introduced into the coke-pulling feedstock storage tank;

(2) When the feeding duration of the coke tower a in the step (1) comprises 30-70% of the total coke-producing cycle, the coking feed of the coke tower a is switched to the coke tower b, the coke tower b repeats the coke-charging process of the coke tower a in the step (1), and the coke tower a is fed with the coke-pulling feedstock heated through a heating furnace b to continue the coke-charging;

(3) When the feeding duration of the coke tower b in the step (2) comprises 30-70% of the total coke-producing cycle, the coking feed of the coke tower b is switched to a coke tower c, the coke tower c repeats the coke-charging process of the coke tower a in the step (1), the coke-pulling feedstock which is heated to a relatively high temperature by the heating furnace b is switched to the coke tower b, the coke tower a is subjected to a steam purging and decoking operation at this time, and reassembled to be on standby for the next coke-charging;

(4) When the feeding duration of the coke tower c in the step (3) comprises 30-70% of the total coke-producing cycle, the coking feed of the coke tower c is switched to the coke tower a, the coke tower a repeats the process in the step (1), the coke-pulling feedstock which is heated to a relatively high temperature by a heating furnace b is switched to the coke tower c, and the coke tower b is subjected to a steam purging and decoking operation at this time, and reassembled to be on standby for the next coke-charging;

(5) When the feeding duration of the coke tower a in the step (4) comprises 30-70% of the total coke-producing cycle, the coking feed of the coke tower a is switched to the coke tower b, the coke tower b repeats the coke-charging process of the coke tower a in the step (1), the coke-pulling feedstock which is heated to a relatively high temperature by a heating furnace b is switched to the coke tower a, and the coke tower c is subjected to a steam purging and decoking operation at this time, and reassembled to be on standby for the next coke-charging; and (6) repeating the processes of the step (3), the step (4) and the step (5).

26. The coking process of any of the preceding or subsequent aspects, wherein the coke tower has a coke-producing cycle of from 24 to 48 hours, the coke-producing cycle being the total time for the coke-charging with the coking feedstock and with the coke-pulling feedstock in a single coke tower.

27. The coking process of any of the preceding or subsequent aspects, wherein the coking feedstock to a coke tower is switched to another coke tower when the feeding duration of the coking feedstock is between 30 and 70 percent of the total coke-producing cycle.

28. The coking process of any of the preceding or subsequent aspects, wherein the temperature at the outlet of furnace a is in the range 400° C. to 460° C. where the gas velocity in the coke tower is controlled to be 0.05 to 0.25 m/s; the outlet temperature of the heating furnace b ranges from 460° C. to 530° C. where the gas velocity in the coke tower is controlled to be 0.10-0.30 m/s.

29. The coking process of any of the preceding or subsequent aspects, wherein the outlet temperature of the furnace a is in the range 420° C. to 450° C. where the gas velocity in the coke tower is controlled to be 0.05 to 0.10 m/s; the outlet temperature of the heating furnace b ranges from 460° C. to 500° C. where the gas velocity in the coke tower is controlled to be 0.15-0.20 m/s.
30. The coking process of any of the preceding or subsequent aspects, wherein the heating furnace a has a heating rate of 1 to 30° C./h, and the heating furnace b has a heating rate of 30 to 150° C./h.
31. The coking process of any of the preceding or subsequent aspects, wherein the heating furnace a has a heating rate of 1 to 10° C./h, and the heating furnace b has a heating rate of 50 to 100° C./h.
32. The coking process of any of the preceding or subsequent aspects, wherein the coker gas oil has a 10% distillate point temperature of from 300° C. to 400° C. and a 90% distillate point temperature of from 450° C. to 500° C.
33. The coking process of any of the preceding or subsequent aspect, wherein the coker gas oil has a 10% distillate point temperature of from 350° C. to 380° C. and a 90% distillate point temperature of from 460° C. to 480° C.
34. The coking process of any of the preceding or subsequent aspects, wherein in the coke-charging to the coke tower with the coke-pulling feedstock (especially the coker gas oil), the ratio of the coke-pulling feedstock to the coke-forming feedstock is controlled to 0 to 4.0.
35. The coking process of any of the preceding or subsequent aspects, wherein the coke-pulling feedstock (particularly coker gas oil) is passed through a filtration unit to remove coke fine particles before being fed to the heating furnace, the coke fine particle concentration of the filtered coke-pulling feedstock being controlled to be 0 to 200 mg/L.
36. The coking process of any of the preceding or subsequent aspects, wherein the coking feedstock is a coal-based feedstock or a petroleum-based feedstock.
37. The coking process in any of the preceding aspects, wherein the coking feedstock is one or more of coal tar or coal tar pitch, petroleum heavy oil, ethylene tar, catalytic cracking residual oil or thermal cracking residual oil.

TECHNICAL EFFECTS

According to the coking system and the coking process, at least one of the following technical effects can be realized:

(1) The petroleum or coal raw materials can be utilized to produce high-quality needle coke with stable performance.
(2) The influence of the feeding physical property, the feeding amount and the temperature and pressure change of a single heating unit on the product property is reduced by arranging a plurality of heating units on the same coke tower and designing each heating unit according to the feeding physical property and the treatment amount of each heating unit.
(3) The operation of multiple heating units and multiple coke towers can create the optimum condition for the a fresh feedstock in the feedstock storage tank to generate a wide-area intermediate phase structure in the coke tower, and when the wide-area intermediate phase structure in the coke tower develops to a certain degree, a necessary coke-pulling process needs to be carried out, so that a later-stage heating stage is changed into a complete coke-charging with a coke-pulling feedstock (such as coker gas oil) which is not easy to coke, the coke-pulling feedstock only plays the role of raising the temperature of the wide-area intermediate phase and pulling the coke in the coke tower, the generation of isotropic coke is limited, the process of generating the wide-area intermediate phase from the a fresh feedstock in the raw material storage tank and the process of raising the temperature by the coke-pulling feedstock are separately implemented, the optimum condition required by each stage is respectively created, the performance of a needle coke product can be effectively improved, and the coefficient of thermal expansion of the needle coke is reduced.
(4) By removing coke fine particles through a filtration device before the coke-pulling feedstock (especially coker gas oil) enters the heating unit, the long-term operation of the system and the improvement of the quality of needle coke are facilitated.
(5) The continuous operation requirement of an industrial delayed coking system can be met by the delayed coking operated by a plurality of coke towers and a plurality of heating units.
(6) The manufactured needle coke has the advantages of stable streamline texture, low coefficient of thermal expansion and the like, and meets the requirements of the needle coke for a large-scale ultrahigh-power graphite electrode.

DESCRIPTION OF THE DRAWINGS

In FIG. 1, 1 is a coke-forming feedstock (also referred to as a fresh feedstock or a coking feedstock), 2 is a heating furnace b, 3 is a heated coke-forming feedstock, 4 is a coke tower (a, b, c), 5 is an oil-gas pipeline, 6 is a fractionation tower, 7 is a coker gas, 8 is a coker naphtha, 9 is coker diesel, 10 is coker gas oil, 11 is a recycled coker gas oil, 12 is a coke-pulling feedstock storage tank, 13 is a supplemental coke-pulling feedstock pipeline, 14 is a heating furnace a, 15 is a heated coke-pulling feedstock, and 16 is a coke fine particles filtration device. The coke-pulling feedstock storage tank 12 is used to store the coker gas oil from line 10 and/or other coke-pulling feedstock from line 17, and the stored feedstock may also be vented to the environment via line 18 and/or transported as a supplemental coke-pulling feedstock via line 13 to the coke fine particles filtration device 16 after mixing with the recycled coker gas oil from line 11 in a predetermined ratio. Depending on the case, the coker gas oil from line 10 and another coke-pulling feedstock from line 17 may be mixed in the coke-pulling feedstock storage tank 12 to form a mixed coke-pulling feedstock. Here, the other coke-pulling feedstock may be an external supply (for example, from other coking system or cracking system), or may be from the coking system of the present invention, for example, may be coker gas oil or coker diesel from the fractionation tower 6.

In FIG. 2, 17 is a fresh feedstock, 18 is a heating furnace, 19 is a heated fresh feedstock, 20 is a coke tower (a, b), 21 is an oil gas pipeline, 22 is a fractionation tower, 23 is a coker gas, 24 is coker naphtha, 25 is coker diesel, 26 is coker gas oil, and 27 is recycled coker gas oil.

Figure 1:
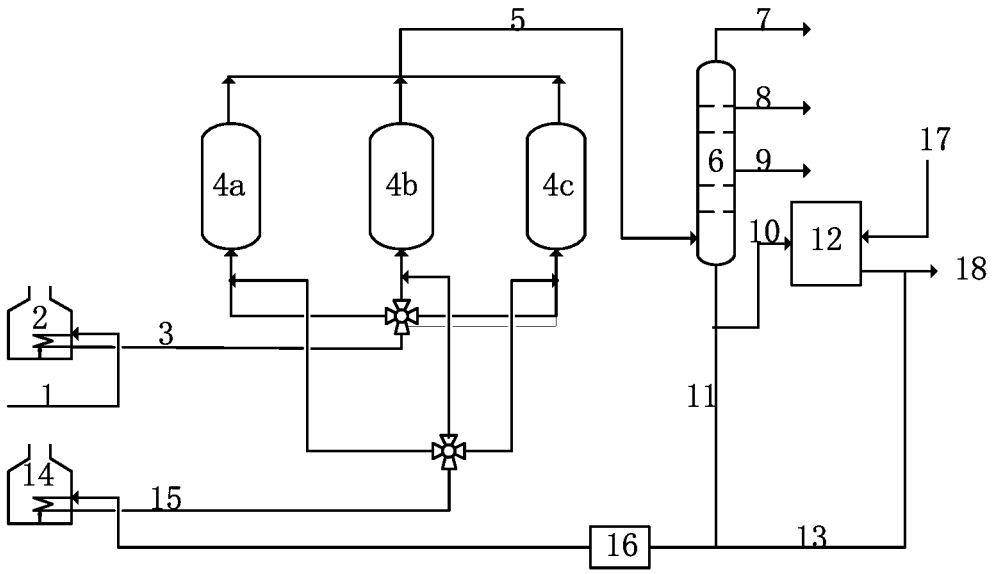
FIG. 1 is an exemplary schematic diagram of a coking system of the present invention, but the invention is not so limited.

In the context of the present invention, the coker gas oil and the recycled coker gas oil are sometimes collectively referred to as coker gas oil without distinction, and the combined coke-pulling feedstock, the other coke-pulling feedstock, and the supplemental coke-pulling feedstock are sometimes collectively referred to as the coke-pulling feedstock without distinction.

DETAILED DESCRIPTION

Reference will now be made in detail to the present embodiments of the present invention, but it should be understood that the scope of the invention is not limited by the embodiments, but is defined by the appended claims.

All publications, patent applications, patents, and other references mentioned in this specification are herein incorporated by reference in their entirety. Unless defined otherwise, all technical and scientific terms used herein have the same meaning as commonly understood by one of ordinary skill in the art to which this invention belongs. In case of conflict, the present specification, including definitions, will control.

When the specification derives materials, substances, methods, procedures, means, or components, or the like with the expressions such as "known to one of ordinary skill in the art", "prior art", or the like, it is intended that the subject matter so derived encompass not only those materials, substances, methods, procedures, means, or components which have been conventionally used in the art at the time of filing this application, but also those which may not be so commonly used at the present time, but will become known in the art as being suitable for a similar purpose.

In the context of the present invention, the coke formation rate is measured in a 10 L tank coking reaction device at a temperature of 500° C., a pressure (gauge pressure) of 0.5 MPa and a coking duration of 10 min. The coke formation rate is determined by the weight ratio of the residual solid in the coking reaction device to the reaction feedstock (such as the coke-forming feedstock or the coke-pulling feedstock) at the end of the coking reaction.

In the context of the present invention, by "communicated with . . . in a material transport manner" is meant that the materials may be transported between each other in one or two directions, such as through a transport pipe or any other means conventionally known to those skilled in the art.

Unless otherwise explicitly indicated, all percentages, parts, ratios, etc. referred to in this specification are by weight, unless not otherwise generally recognized by those of skill in the art.

In the context of this specification, any two or more embodiments of the invention may be combined in any combination, and the resulting solution is a part of the original disclosure of this specification, and is within the scope of the invention.

According to one embodiment of the present invention, a coking system is disclosed that includes from the 1st to the m-th (a total of m) heating units and from the 1st to the n-th (a total of n) coke towers. Here, m is any integer of 2 to n−1, and n is any integer of 3 or more, preferably any integer of 3 to 20, more preferably any integer of 3 to 5, and still more preferably 3.

According to one embodiment of the present invention, each of the m heating units is in communication with the n coke towers, respectively. This communication may be accomplished in any manner conventionally known to those skilled in the art, such as a multi-way valve, and in particular a four-way valve (as shown in FIG. 1), but the invention is not limited thereto.

According to one embodiment of the present invention, each of the n coke towers is in communication with one or more separation towers, respectively. Preferably, the upper part and/or the overhead of the coke tower (preferably the overhead) are in communication with the separation tower.

According to one embodiment of the invention, the one or more separation towers are in communication with the m-th heating unit. Preferably, the lower part and/or the bottom of the tower (preferably the bottom of the tower) of one or more separation towers is/are in communication with the m-th heating unit.

According to an embodiment of the present invention, the one or more separation towers may be further communicated with the i-th heating unit, as the case may be. Here, i is any integer greater than 1 and less than m. Preferably, the lower part of the tower and/or the bottom of the tower (preferably the bottom of the tower) of one or more separation towers is/are in communication with the i-th heating unit.

According to an embodiment of the present invention, the one or more separation towers are not in communication with the 1st heating unit in order to further improve the performance of needle coke and to make the coking operation of the coking system smoother on the basis of the present invention. Here, the communication includes the cases of direct communication via pipeline and indirect communication with other devices such as a tank or a filter interposed therebetween.

In the context of the present invention, as said communication, it is generally meant the communication in a material transport manner, in particular the communication in a unidirectional material transport manner.

According to one embodiment of the present invention, the type of the heating unit is not particularly limited, and any heating device may be used as long as it can heat the material transported through the unit to a predetermined temperature, for example heat-exchanger and heating furnace, preferably heating furnace.

According to an embodiment of the present invention, the type of the separation tower is not particularly limited, and any separation apparatus may be used as long as it can separate the material fed to the separation tower into a plurality of components according to a predetermined requirement, and specific examples thereof include a rectification tower, a flash tower, an evaporation tower, a fractionation tower, and the like, and a fractionation tower is preferable.

According to an embodiment of the present invention, the number of the separation towers is not particularly limited, and specifically, 1 to 10, 1 to 5, 1 to 3, or 1 tower may be mentioned.

According to one embodiment of the invention, the coking system is a coking unit that includes three coke towers, two sets of furnaces, a fractionation tower, and a coke-pulling feedstock storage tank. If the three coke towers are respectively marked as a coke tower a, a coke tower b and a coke tower c, and the two sets of heating furnaces are respectively marked as a heating furnace a and a heating furnace b, any one coke tower is connected with the two sets of heating furnaces, the top of any coke tower is connected with the inlet of the fractionation tower via pipeline, and the bottom outlet of the fractionation tower is connected with the coke-pulling feedstock storage tank. In addition, the coke-pulling feedstock storage tank is connected with the heating furnace b to heat the materials from the coke-pulling feedstock storage tank to the feeding temperature of the coke tower. And the heating furnace a is connected with the feedstock tank to heat the coking feedstock to the feeding temperature of the coke tower.

According to one embodiment of the present invention, in the coking unit, a filtration device is provided between the raw coke-pulling feedstock tank and the heating furnace b.

According to an embodiment of the present invention, the coking system may further comprise a control unit.

According to an embodiment of the present invention, assuming T0 is a coke-charging starting time and Te is a coke-charging termination time for the h-th coke tower of the n coke towers, the control unit is configured to enable to start and terminate the material transport of each heating unit to the h-th coke tower sequentially in the order from the 1st heating unit to the m-th heating unit from the time T0, and terminate the material transport of the m-th heating unit to the h-th coke tower at the time Te. Here, h is any integer from 1 to n.

According to one embodiment of the present invention, at the time Te, the sum of the material transport amounts of the 1st to the m-th heating units to the h-th coke tower is equal to the target coke-charging capacity of the h-th coke tower. In the context of the present invention, by "target coke-charging capacity" is meant the maximum safe coke-charging capacity allowed for the coke tower.

In the context of the present invention, the material transport from the 1st heating unit to the m-th heating unit to the h-th coke tower is completed from the time T0to the time Te, which is referred to as a material transport cycle.

According to one embodiment of the present invention, each of the 1st to the m-th heating units transports only one batch of material to the h-th coke tower during one material transport cycle. The transport can be carried out here in a continuous, semi-continuous or batch manner.

According to one embodiment of the invention, the h-th coke tower does not accept the material transport at any time during a material transport cycle.

According to one embodiment of the present invention, the h-th coke tower accepts only the material transport from only one of the 1st to the m-th heating units at any time during a single material transport cycle.

According to one embodiment of the invention, after a material transport cycle is complete, the h-th coke tower is purged and decoked, and then the h-th coke tower is on standby.

According to one embodiment of the invention, after a material transport cycle is complete, the h-th coke tower is purged and decoked, and then the next material transport cycle is started for the h-th coke tower.

According to one embodiment of the invention, each of the 1st to the m-th heating units is configured to heat its transport material to the feeding temperature required by the h-th coke tower for that transport material.

According to one embodiment of the invention, the 1st heating unit heats its transport material (referred to as the 1st transport material) to a feeding temperature W1 of 400° C. to 480° C. (preferably 420° C. to 460° C.).

According to one embodiment of the invention, the 1st transport material brings the intra-tower gas velocity G1 in the h-th coke tower to 0.05-0.25 m/s, preferably 0.05-0.10 m/s.

According to one embodiment of the invention, the m-th heating unit heats its transport material (referred to as the m-th transport material) to a feeding temperature Wm in the range of 460° C. to 530° C., preferably 460° C. to 500° C.

According to one embodiment of the invention, the m-th transport material brings the intra-tower gas velocity Gm in the h-th coke tower to 0.10-0.30 m/s, preferably 0.15-0.20 m/s.

According to one embodiment of the invention, the i-th heating unit heats its transport material (referred to as the i-th transport material) to a feeding temperature Wi, where $W1 \leq Wi \leq Wm$. Here, i is any integer greater than 1 and less than m.

According to one embodiment of the present invention, the i-th transport material allows the intra-tower gas velocity in the h-th coke tower Gi to reach $G1 \leq Gi \leq Gm$.

According to one embodiment of the invention, the heating rate V1 of the 1st heating unit for its transport material is 1-30° C./h, preferably 1-10° C./h. After reaching the corresponding feeding temperature, the temperature is maintained constant.

According to one embodiment of the invention, the heating rate Vm of the m-th heating unit for its transport material is 30-150° C./h, preferably 50-100° C./h. After reaching the corresponding feeding temperature, the temperature is maintained constant.

According to one embodiment of the invention, the heating rate Vi of the i-th heating unit for its transport materials meets the relation $V1 \leq Vi \leq Vm$. Here, i is any integer greater than 1 and less than m. After reaching the corresponding feeding temperature, the temperature is maintained constant.

According to one embodiment of the invention, the upper part and/or the overhead (e.g., the top) of each of the n coke towers is communicated in a material transport manner with the one or more separation towers. In other words, the upper material and/or overhead material (such as overhead material) of each of the n coke towers are transported to the one or more separation towers.

According to one embodiment of the invention, in the one or more separation towers, the overhead material of each coke tower is split into at least the overhead material of the separation tower and the bottom material of the separation tower, e.g. the overhead material may be split into an overhead material (commonly referred to as coker gas), a plurality of tower side materials (e.g. including naphtha and coker gas oil) and the bottom material. In the context of the present invention, the bottom material of the separation tower is sometimes also referred to as coker gas oil.

According to one embodiment of the invention, the coker gas oil has a 10% distillate point temperature of from 300° C. to 400° C., preferably from 350° C. to 380° C., and a 90% distillate point temperature of from 450° C. to 500° C., preferably from 460° C. to 480° C.

According to one embodiment of the invention, the operating conditions of the one or more separation towers comprise: the pressure at the top of the tower is 0.01-0.8 MPa, the temperature at the top of the tower is 100-200° C., and the temperature at the bottom of the tower is 280-400° C.

According to one embodiment of the present invention, the operating conditions of then coke towers, which are identical to or different from each other, each independently comprise: the pressure at the top of the tower is 0.01-1.0 MPa, the temperature at the top of the tower is 300-470° C., and the temperature at the bottom of the tower is 350-510° C.

According to one embodiment of the invention, the 1st heating unit uses the coke-forming feedstock as the transport material. To this end, the coking system may also generally include at least one coke-forming feedstock storage tank (sometimes also referred to as the feedstock tank) for the smooth operation.

According to one embodiment of the invention, the at least one coke-forming feedstock tank is in communication with the 1st heating unit for transporting coke-forming feedstock in the at least one coke-forming feedstock tank to the 1st heating unit.

According to an embodiment of the present invention, in order to further improve the performance of needle coke and make the coking operation process of the coking system smoother based on the present invention, the 1st heating unit only uses a coke-forming feedstock as the transportation material, and does not use a coke-pulling feedstock, especially does not use the bottom material of the separation tower or coker gas oil as the transportation material, even if it is a part of the transportation material. In other words, the at least one coke-forming feedstock storage tank is not in communication with the m-th heating unit. Here, the communication includes the case of direct communication via pipeline and indirect communication with other devices such as a tank or a filter interposed therebetween.

According to one embodiment of the invention, the m-th heating unit uses a coke-pulling feedstock as the transport material. Preferably, the coke-pulling feedstock comprises at least the bottom material of the one or more separation towers. In the present invention, the ratio of the bottom material in the coke-pulling feedstock (generally referred to as make-up ratio) is not particularly limited, but may be generally 0 to 80%, preferably 30 to 70%, more preferably 50 to 70%.

According to an embodiment of the present invention, the at least one coke-forming feedstock storage tank is not in communication with the m-th heating unit in order to further improve the performance of needle coke and to make the coking operation of the coking system smoother on the basis of the present invention. Here, the communication includes the case of direct communication via pipeline and indirect communication with other devices such as a tank or a filter interposed therebetween. In other words, the m-th heating unit uses only the coke-pulling feedstock as its transported material, and does not use the coke-forming feedstock as its transported material.

According to one embodiment of the present invention, the i-th heating unit has at least one selected from the coke-forming feedstock and the coke-pulling feedstock as the transport material. For this purpose, depending on the type of material transport of the i-th heating unit, the at least one coke-forming feedstock storage tank may be in communication with the i-th heating unit (when the coke-forming feedstock is used as the transport material) or may be not in communication with the i-th heating unit (when the other materials are used as the transport material). Here, i is any integer greater than 1 and less than m.

According to one embodiment of the present invention, the coke-forming feedstock is selected from at least one of a coal-based feedstock and a petroleum-based feedstock, preferably at least one of coal tar, coal tar pitch, heavy petroleum oil, ethylene tar, catalytic cracking residue, or thermal cracking residue.

According to one embodiment of the invention, the coke formation rate of the coke-forming feedstock (referred to as coke formation rate A) is generally 10 to 80%, preferably 20 to 70%, more preferably 30 to 60%.

According to one embodiment of the invention, the sulfur content of the coke-forming feedstock is generally <0.6 wt %, preferably <0.5 wt %. For this reason, the coke-forming feedstock is usually refined.

According to one embodiment of the invention, the colloid and asphaltene content of the coke-forming feedstock is generally <10.0 wt %, preferably <5.0 wt %, more preferably <2.0 wt %. Here, the colloid and asphaltene contents are measured according to the standard SH/T05094-2010.

According to one embodiment of the invention, the 10% distillate point temperature of the bottom material of the one or more separation towers is from 300° C. to 400° C., preferably from 350° C. to 380° C., and the 90% distillate point temperature is from 450° C. to 500° C., preferably from 460° C. to 480° C.

According to an embodiment of the present invention, the coke-pulling feedstock is selected from at least one of coal-based raw material and petroleum-based raw material, preferably at least one of coker gas oil, coker diesel, ethylene tar and thermally cracked heavy oil. The coke-pulling feedstock (especially coker gas oil) may be obtained from the aforementioned separation tower (e.g., as the bottom material of the separation tower), or may be obtained from another source, such as commercially available or produced by any method known in the art, and is not particularly limited.

According to one embodiment of the invention, the coke-pulling feedstock comprises at least the bottom material of the one or more separation towers. In the present invention, the ratio of the bottom material in the coke-pulling feedstock (generally referred to as make-up ratio) is not particularly limited, but may be generally 0 to 80%, preferably 30 to 70%, more preferably 50 to 70%.

According to one embodiment of the invention, the coke formation rate of the coke raw material (referred to as coke formation rate B) is generally 1 to 40%, preferably 1 to 20%, more preferably 1 to 10%.

According to one embodiment of the invention, the coke formation rate A>the coke formation rate B.

According to one embodiment of the invention, the sulfur content of the coke-pulling feedstock is generally <1.0 wt %, preferably <0.6 wt %.

According to one embodiment of the present invention, the weight ratio of the total amount of the coke-pulling feedstock to the total amount of the coke-forming feedstock transported to the h-th coke tower during a single material transport cycle (referred to as the "pulling/forming ratio") is generally in the range of from 0.5 to 4.0, preferably in the range of from 1.0 to 2.0. Here, h is any integer from 1 to n.

According to one embodiment of the present invention, the h-th coke tower has a coke-charging cycle T of 10 to 60 hours, preferably 24 to 48 hours, assuming Te-T0=T.

According to one embodiment of the invention, the coke-charging cycles T of the n coke towers, which are identical to or different from each other (preferably identical to each other), are each independently from 10 to 60 hours, preferably from 24 to 48 hours.

According to an embodiment of the present invention, in one material transport cycle, assuming that said one material transport cycle is TC (in hours), and the material transport times of said the 1st to the m-th heating units to said h-th coke tower are D1 to Dm, respectively (in hours), D1/TC=10-90% or 30-70%, D2/TC=10-90% or 30-70%, . . . , Dm/TC=10-90% or 30-70%, and TC/2≤D1+D2+ . . . +Dm≤TC, preferably D1+D2+ . . . +Dm=TC.

According to an embodiment of the invention, D1=D2= . . . =Dm=TC/m=T/m, and D1+D2+ . . . +Dm=TC=T, where T is the coke-charging cycle of the h-th coke tower.

According to an embodiment of the present invention, assuming that any two of the n coke towers that are numbered adjacent (number 1 and number n are defined as being numbered adjacent) are the a-th coke tower and the b-th coke tower, respectively, the control unit is configured to start and stop the material transport of the j-th heating unit to the a-th coke tower, and then start and stop the material transport of the j-th heating unit to the b-th coke tower. Here, j is any integer of 1 to m. In addition, a is any integer from 1 to n, and b is any integer from 1 to n, but a≠b. In other words, assuming that any two of the n coke towers that are numbered adjacent are the a-th coke tower and the b-th coke tower, respectively, the material transport from the j-th heating unit to the b-th coke tower is started (after a necessary delay time has elapsed, as the case may be) at the time when the material transport from the j-th heating unit to the a-th coke tower is completed.

According to an embodiment of the present invention, there is also provided a coking process comprising the step of coking with m heating units and n coke towers. Alternatively, the process comprises the step of coking using the coking system of the present invention as described hereinbefore. Except for what is specifically described below, all the matters or contents of the coking process which are not specified can be directly applied to the corresponding description of the coking system, and are not described in detail herein.

According to one embodiment of the invention, in the coking process, at least a portion of the upper material and/or the overhead material (such as the overhead material) of each of the n coke towers is transported to the one or more separation towers, and at least a portion of the lower material and/or the bottom material of the one or more separation towers is transported to the m-th heating unit, and optionally to the i-th heating unit. Here, i is any integer greater than 1 and less than m. The term "at least a portion of" means, for example, 10 wt % or more, 20 wt % or more, 30 wt % or more, 40 wt % or more, 50 wt % or more, 60 wt % or more, 70 wt % or more, 80 wt % or more, 90 wt % or more, or 100 wt %.

According to one embodiment of the invention, the lower material and/or the bottom material of the one or more separation towers, even at least a portion thereof, is not fed to the 1st heating unit in order to further improve the performance of the needle coke and to make the coking operation of the coking system smoother on the basis of the invention.

According to one embodiment of the invention, the coking device used in the coking process comprises three coke towers, two sets of heating furnaces, a fractionation tower and a coke-pulling feedstock storage tank, wherein the three coke towers are respectively marked as a coke tower a, a coke tower b and a coke tower c; the two sets of heating furnaces are respectively marked as a heating furnace a and a heating furnace b, any coke tower is connected with the two sets of heating furnaces, the top of any coke tower is connected with the inlet of the fractionation tower via pipeline, the bottom outlet of the fractionation tower is connected with the coke-pulling feedstock storage tank, the heating furnace b is connected with the coke-pulling feedstock storage tank and is used for heating the material from the coke-pulling feedstock storage tank to the feeding temperature of the coke tower, and the heating furnace a is connected with the feedstock tank and is used for heating a fresh feedstock to the feeding temperature of the coke tower;

The specific operation process is as follows:

(1) The coking feedstock is heated by the heating furnace a and enters the coke tower a, the generated oil gas enters the fractionation tower and is fractionated to obtain gas, coker gasoline, coker diesel and coker gas oil at the tower bottom, wherein the coker gas oil at the tower bottom is introduced into the coke-pulling feedstock storage tank;

(2) When the feeding duration of the coke tower a in the step (1) comprises 30-70% of the total coke-producing cycle, the coking feed of the coke tower a is switched to the coke tower b, the coke tower b repeats the coke-charging process of the coke tower a in the step (1), and the coke tower a is fed with the coke-pulling feedstock heated through a heating furnace b to continue the coke-charging;

(3) When the feeding duration of the coke tower b in the step (2) comprises 30-70% of the total coke-producing cycle, the coking feed of the coke tower b is switched to a coke tower c, the coke tower c repeats the coke-charging process of the coke tower a in the step (1), the coke-pulling feedstock which is heated to a relatively high temperature by the heating furnace b is switched to the coke tower b, the coke tower a is subjected to a steam purging and decoking operation at this time, and reassembled to be on standby for the next coke-charging;

(4) When the feeding duration of the coke tower c in the step (3) comprises 30-70% of the total coke-producing cycle, the coking feed of the coke tower c is switched to the coke tower a, the coke tower a repeats the process in the step (1), the coke-pulling feedstock which is heated to a relatively high temperature by a heating furnace b is switched to the coke tower c, and the coke tower b is subjected to a steam purging and decoking operation at this time, and reassembled to be on standby for the next coke-charging;

(5) When the feeding duration of the coke tower a in the step (4) comprises 30-70% of the total coke-producing cycle, the coking feed of the coke tower a is switched to the coke tower b, the coke tower b repeats the coke-charging process of the coke tower a in the step (1), the coke-pulling feedstock which is heated to a relatively high temperature by a heating furnace b is switched to the coke tower a, and the coke tower c is subjected to a steam purging and decoking operation at this time, and reassembled to be on standby for the next coke-charging; and (6) repeating the processes of the step (3), the step (4) and the step (5).

According to an embodiment of the present invention, it is assumed that m=2, n=3, 3 coke towers are respectively marked as coke tower a, coke tower b and coke tower c, and 2 heating units are respectively marked as heating unit a and heating unit b, the overhead material (oil gas) of each of the 3 coke towers is in communication with one of the separation towers in a material transport manner, the heating unit a transports and heats a coke-forming feedstock, and the heating unit b transports and heats a coke-pulling feedstock, the coking process comprises at least the steps of:

(1) Feeding the coke-forming feedstock into the coke tower a, and introducing the oil gas generated by the coke tower a into the separation tower to separate off at least coker gas oil;

(2) When the feeding duration of the coke tower a reaches 30-70% (preferably about 50%) of the coke-charging cycle T of the coke tower a, stopping feeding the coke-forming feedstock to the coke tower a, simultaneously starting to feed the coke-forming feedstock to the coke tower b and starting to feed the coke-pulling feedstock to the coke tower a, and feeding the oil gas generated by the coke tower b to the separation tower to separate off at least coker gas oil;

(3) When the feeding duration of the coke tower b reaches 30-70% (preferably about 50%) of the coke-charging cycle T of the coke tower b, stopping feeding the coke-forming feedstock to the coke tower b, simultaneously starting to feed the coke-forming feedstock to the coke tower c, starting to feed the coke-pulling feedstock to the coke tower b, and stopping feeding the coke-pulling feedstock to the coke tower a, and feeding the oil gas generated by the coke tower c to the separation tower to separate off at least coker gas oil;

(4) Performing steam purging and decoking operations on the coke tower a;

(5) When the feeding duration of the coke tower c reaches 30-70% (preferably about 50%) of the coke-charging cycle T of the coke tower c, stopping feeding the coke-forming feedstock to the coke tower c, simultaneously starting to feed the coke-forming feedstock to the coke tower a, starting to feed the coke-pulling feedstock to the coke tower c and stopping feeding the coke-pulling feedstock to the coke tower b, and feeding the oil gas generated by the coke tower a to the separation tower to separate off at least coker gas oil;

(6) Performing steam purging and decoking operations on the coke tower b;

(7) When the feeding duration of the coke tower a reaches 30-70% (preferably about 50%) of the coke-charging cycle T of the coke tower a, stopping feeding the coke-forming feedstock to the coke tower a, and simultaneously starting to feed the coke-forming feedstock to the coke tower b, starting to feed the coke-pulling feedstock to the coke tower a and stopping feeding the coke-pulling feedstock to the coke tower c, and feeding the oil gas generated by the coke tower b to the separation tower to separate off at least coker gas oil;

(8) Performing steam purging and decoking operations on the coke tower c; and (9) Repeating the steps (3) to (8).

According to one embodiment of the invention, at least one material selected from the group consisting of the coke-forming feedstock and the coke-pulling feedstock is filtered before entering the respective heating unit and/or entering the respective coke tower. By this filtration, the coke fine particle concentration of the material is generally controlled to 0 to 200 mg/L, preferably 0 to 100 mg/L, more preferably 0 to 50 mg/L. Here, as the filtration method, for example, fine filtration, centrifugal separation, flocculation separation and the like can be mentioned, and fine filtration is preferable. These filtration methods may be used singly or in combination of two or more at an arbitrary ratio. As said material, it is preferably said coke-pulling feedstock, more preferably the bottom material of said one or more separation towers or coker gas oil. Preferably, said material is subjected to said filtration before entering the respective heating unit, more preferably said material (in particular said coker gas oil) is subjected to said filtration before entering the m-th heating unit, and/or said material (in particular said coker gas oil) is subjected to said filtration before entering the i-th heating unit. Here, i is any integer greater than 1 and less than m.

According to one embodiment of the invention, the coking system further optionally comprises at least one filtration device provided at the inlet and/or outlet of at least one of the heating units. Preferably, the at least one filtration device is provided at the inlet and/or outlet of the m-th heating unit. Optionally, the at least one filtration device is provided at the inlet and/or outlet of the i-th heating unit. Here, i is any integer greater than 1 and less than m. The filtration device of the present invention is not particularly limited, and any filtration device conventionally used in the art may be used as long as the desired filtration object can be achieved, and specific examples thereof include a fine filtration device, a centrifugal separation device, and a flocculation separation device. The inlet is referred to as the transport material inlet and the outlet is referred to as the transport material outlet.

According to one embodiment of the invention, the coking system comprises at least three coke towers and two heating units; any coke tower is communicated with the at least two heating units, said two heating units are used for heating feedstock 1 and feedstock 2, respectively, to a feeding temperature, and said any coke tower is in communication with a fractionation tower. Here, the feedstock 1 is typically a fresh coker feedstock, and the feedstock 2 is typically a coke-pulling feedstock (especially coker gas oil).

According to one embodiment of the invention, the coking system comprises three coke towers, two sets of heating furnaces, a fractionation tower and a coke-pulling feedstock storage tank, wherein the three coke towers are respectively marked as a coke tower a, a coke tower b and a coke tower c; the two sets of heating furnaces are respectively marked as a heating furnace a and a heating furnace b, any coke tower is communicated with the two sets of heating furnaces, the top of any coke tower is communicated with the inlet of a fractionation tower via pipeline, the bottom outlet of the fractionation tower is communicated with the coke-pulling feedstock storage tank, the coke-pulling feedstock storage tank is communicated with the heating furnace b to heat the material in the coke-pulling feedstock storage tank to the feeding temperature of the coke tower, and the heating furnace a is communicated with the feedstock tank to heat the coking feedstock to the feeding temperature of the coke tower.

According to a preferred embodiment of the present invention, the coking system includes three coke towers and two heating furnaces, the three coke towers are respectively denoted as a coke tower a, a coke tower b, and a coke tower c, the two heating furnaces are respectively denoted as a heating furnace 1 and a heating furnace 2, any one coke tower is communicated with at least two heating furnaces, the two heating furnaces are respectively used for heating the raw material 1 and the raw material 2 to the feeding temperature, and any one coke tower is communicated with a fractionation tower. Here, the feedstock 1 is generally a fresh feedstock, and the feedstock 2 is generally a coke-pulling feedstock (in particular coker gas oil).

According to a preferred embodiment of the present invention, the specific operation of the coking system is as follows:

(1) Heating a raw material 1 by a heating furnace 1, then feeding the heated raw material into a coke tower a, feeding the generated oil gas into a fractionation tower, and fractionating to obtain gas, coker gasoline, coker diesel and coker gas oil at the tower bottom;

(2) When the feeding duration of the coke tower a in the step (1) comprises 30-70% of the coke-charging cycle, switching the raw material 1 heated by the heating furnace 1 to a coke tower b, repeating the coke-charging process of the coke tower a in the step (1) on the coke tower b, and feeding the coke tower a with the coke-pulling feedstock heated through a heating furnace b to continue the coke-charging;

(3) When the feeding duration of the coke tower b in the step (2) comprises 30-70% of the coke-charging cycle, switching the raw material 1 heated by the heating furnace 1 to a coke tower c, repeating the coke-charging process of the coke tower a in the step (1) on the coke tower c, switching the raw material 2 heated by the heating furnace b to the coke tower b, and subjecting the coke tower a to a steam purging and decoking operation at this time, and reassembling to be on standby for the next coke-charging;

(4) When the feeding duration of the coke tower c in the step (3) comprises 30-70% of the coke-charging cycle, switching the raw material 1 heated by the heating furnace 1 to a coke tower a, repeating the coke-charging process of the coke tower a in the step (1), switching the raw material 2 heated by the heating furnace b to the coke tower c, and subjecting the coke tower b to a steam purging and decoking operation at this time, and reassembling to be on standby for the next coke-charging;

(5) When the feeding duration of the coke tower a in the step (4) comprises 30-70% of the coke-charging cycle, switching the raw material 1 heated by the heating furnace 1 to a coke tower b, repeating the coke-charging process of the coke tower a in the step (1) on the coke tower b, switching the raw material 2 heated by the heating furnace b to the coke tower a, and subjecting the coke tower c to a steam purging and decoking operation at this time, and reassembling to be on standby for the next coke-charging;

(6) repeating the processes of the step (3), the step (4) and the step (5).

According to one embodiment of the invention, in the coking system, the coke tower has a coke-charging cycle of 24-48 h, wherein the coke-charging cycle is the total coke-charging time of the coke-forming feedstock and the coke-pulling feedstock (such as coker gas oil) in a single coke tower.

According to one embodiment of the invention, in the coking system, when the feeding duration of the coke-forming feedstock comprises 30-70% of the coke-charging cycle, the coking feed to a coke tower is switched to another coke tower.

According to one embodiment of the invention, in the coking system, the outlet temperature of the heating furnace a ranges from 400° C. to 460° C., preferably from 420° C. to 450° C., while the intra-tower gas velocity in the coke tower is controlled to be 0.05 to 0.25 m/s, preferably 0.05 to 0.10 m/s.

According to one embodiment of the invention, in the coking system, the heating rate of the heating furnace a is 1 to 30° C./h, preferably 1 to 10° C./h.

According to one embodiment of the present invention, in the coking system, the outlet temperature of the heating furnace b is in the range of 460° C. to 530° C., preferably 460° C. to 500° C., while the intra-tower gas velocity in the coke tower is controlled to be 0.10 to 0.30 m/s, preferably 0.15 to 0.20 m/s.

According to one embodiment of the invention, in the coking system, the heating rate of the heating furnace b is 30 to 150° C./h, preferably 50 to 100° C./h.

According to a preferred embodiment of the present invention, a coking system used by the coking process comprises three coke towers, two sets of heating furnaces, a fractionation tower and a coke-pulling feedstock storage tank, wherein the three coke towers are respectively marked as a coke tower a, a coke tower b and a coke tower c; the two sets of heating furnaces are respectively marked as a heating furnace a and a heating furnace b, any coke tower is communicated with the two sets of heating furnaces, the top of any coke tower is communicated with the inlet of a fractionation tower via pipeline, the bottom outlet of the fractionation tower is communicated with a coke-pulling feedstock storage tank, the heating furnace b is communicated with the coke-pulling feedstock storage tank to heat the material in the coke-pulling feedstock storage tank to the feeding temperature of the coke tower, and the heating furnace a is communicated with the feedstock tank to heat a fresh feedstock to the feeding temperature of the coke tower.

According to this preferred embodiment of the invention, the specific operating procedure of the coking process is as follows:

(1) A coke-forming feedstock is heated by a heating furnace a and enter a coke tower a, the generated oil gas enters a fractionation tower, and the generated oil gas enters the fractionation tower and is fractionated to obtain gas, coker gasoline, coker diesel and coker gas oil at the tower bottom, wherein the coker gas oil at the tower bottom is introduced into the coke-pulling feedstock storage tank;

(2) When the feeding duration of the coke tower a in the step (1) comprises 30-70% of the total coke-charging cycle, the coking feed of the coke tower a is switched to the coke tower b, the coke tower b repeats the coke-charging process of the coke tower a in the step (1), and the coke tower a is fed with the coke-pulling feedstock heated through a heating furnace b to continue the coke-charging;

3) When the feeding duration of the coke tower b in the step (2) comprises 30-70% of the total coke-charging cycle, the coking feed of the coke tower b is switched to a coke tower c, the coke tower c repeats the coke-charging process of the coke tower a in the step (1), the coke-pulling feedstock which is heated to a relatively high temperature by the heating furnace b is switched to the coke tower b, the coke tower a is subjected to a steam purging and decoking operation at this time, and reassembled to be on standby for the next coke-charging;

(4) When the feeding duration of the coke tower c in the step (3) comprises 30-70% of the total coke-charging cycle, the coking feed of the coke tower c is switched to the coke tower a, the coke tower a repeats the process in the step (1), the coke-pulling feedstock which is heated to a relatively high temperature by a heating furnace b is switched to the coke tower c, and the coke tower b is subjected to a steam purging and decoking operation at this time, and reassembled to be on standby for the next coke-charging;

(5) When the feeding duration of the coke tower a in the step (4) comprises 30-70% of the total coke-charging cycle, the coking feed of the coke tower a is switched to the coke tower b, the coke tower b repeats the coke-charging process of the coke tower a in the step (1), the coke-pulling feedstock which is heated to a relatively high temperature by a heating furnace b is switched to the coke tower a, and the coke tower c is subjected to a steam purging and decoking operation at this time, and reassembled to be on standby for the next coke-charging; and (6) Repeating the processes of the step (3), the step (4) and the step (5).

According to one embodiment of the invention, in the coking process, the coke tower has a coke-charging cycle of 24-48 h, and said coke-charging cycle is the total charging time of the coke-forming feedstock and the coke-pulling feed (such as coker gas oil) in a single coke tower.

According to one embodiment of the invention, in the coking system, when the feeding duration of the coke-forming feedstock comprises 30-70% of the coke-charging cycle, the coking feed to a coke tower is switched to another coke tower.

According to one embodiment of the invention, in the coking process, the outlet temperature of the heating furnace a ranges from 400° C. to 460° C., preferably from 420° C. to 450° C., while the intra-tower gas velocity in the coke tower is controlled to be 0.05 to 0.25 m/s, preferably 0.05 to 0.10 m/s.

According to one embodiment of the present invention, in the coking process, the heating rate of the heating furnace a is 1 to 30° C./h, preferably 1 to 10° C./h.

According to one embodiment of the present invention, in the coking process, the outlet temperature of the heating furnace b is in the range of 460° C. to 530° C., preferably 460° C. to 500° C., while the intra-tower gas velocity in the coke tower is controlled to be 0.10 to 0.30 m/s, preferably 0.15 to 0.20 m/s.

According to one embodiment of the present invention, in the coking process, the heating rate of the heating furnace b is 30 to 150° C./h, preferably 50 to 100° C./h.

The present invention will be described in further detail with reference to the accompanying drawings, but the present invention is not limited thereto.

As shown in FIG. 1:

(1) Feedstock 1 is firstly fed as a coke-forming feedstock through a heating furnace 2 to a coke tower 4*a*. The oil gas generated by the coke tower 4*a* is fed to a separation tower 6 via pipeline 5, and separated to produce a gas 7, a gasoline 8 and a diesel 9, which leave the separation tower for the further treatment, and a coker gas oil, which leaves the separation tower from the bottom of the tower;

(2) When the feeding duration of the coke tower 4*a* reaches 30-70% of the coke-charging cycle T of the coke tower 4*a*, the feeding of the coke-forming feedstock to the coke tower 4*a* is stopped, simultaneously the feeding of the coke-forming feedstock to the coke tower 4*b* is started and the feeding of a supplementary coke-pulling feedstock in a coke-pulling feedstock storage tank 12 through a filtration device 16 via pipeline 13 and a heating furnace 14 (where the feedstock is heated) to the coke tower 4*a* is started. The oil gas generated by the coke towers 4*a* and 4*b* is fed to the separation tower 6, and separated to produce a gas 7, a gasoline 8 and a diesel 9 that leave the separation tower for the further treatment, and a coker gas oil at the bottom of the tower, a part of which is fed to the coke-pulling feedstock storage tank 12 via pipeline 10, and another part of which is recycled via pipeline 11 and mixed with the supplementary coke-pulling feedstock from the pipeline 13 to return to the coke tower 4*a;*

(3) When the feeding duration of the coke tower 4*b* reaches 30-70% of the coke-charging cycle T of the coke tower 4*b*, the feeding of the coke-forming feedstock to the coke tower 4*b* is stopped, simultaneously the feeding of the coke-forming feedstock to the coke tower 4*c* is started, the feeding of the coke-pulling feedstock to the coke tower 4*b* is started and the feeding of the coke-pulling feedstock to the coke tower 4*a* is stopped. The oil gas generated by the coke towers 4*b* and 4*c* is fed to the separation tower 6, and separated to produce a gas 7, a gasoline 8 and a diesel 9 that leave the separation tower for the further treatment, and a coker gas oil at the bottom of the tower, a part of which is fed to the coke-pulling feedstock storage tank 12 via pipeline 10, and another part of which is recycled via pipeline 11 and mixed with the supplementary coke-pulling feedstock from the pipeline 13 to return to the coke tower 4*b;*

(4) Performing steam purging and decoking on the coke tower 4*a* to be on standby;

(5) When the feeding duration of the coke tower 4*c* reaches 30-70% of the coke-charging cycle T of the coke tower 4*c*, the feeding of the coke-forming feedstock to the coke tower 4*c* is stopped, simultaneously the feeding of the coke-forming feedstock to the coke tower 4*a* is started, the feeding of the coke-pulling feedstock to the coke tower 4*c* is started and the feeding of the coke-pulling feedstock to the coke tower 4*b* is stopped. The oil gas generated by the coke towers 4*a* and 4*c* is fed to the separation tower 6, and separated to produce a gas 7, a gasoline 8 and a diesel 9 that leave the separation tower for the further treatment, and a coker gas oil at the bottom of the tower, a part of which is fed to the coke-pulling feedstock storage tank 12 via pipeline 10, and another part of which is recycled via pipeline 11 and mixed with the supplementary coke-pulling feedstock from the pipeline 13 to return to the coke tower 4*c;*

(6) Performing steam purging and decoking on the coke tower 4*b* to be on standby;

(7) When the feeding duration of the coke tower 4*a* reaches 30-70% of the coke-charging cycle T of the coke tower 4*a*, the feeding of the coke-forming feedstock to the coke tower 4*a* is stopped, simultaneously the feeding of the coke-forming feedstock to the coke tower 4*b* is started, the feeding of the coke-pulling feedstock to the coke tower 4*a* is started and the feeding of the coke-pulling feedstock to the coke tower 4*c* is stopped. The oil gas generated by the coke towers 4*a* and 4*b* is fed to the separation tower 6, and separated to produce a gas 7, a gasoline 8 and a diesel 9 that leave the separation tower for the further treatment, and a coker gas oil at the bottom of the tower, a part of which is fed to the coke-pulling feedstock storage tank 12 via pipeline 10, and another part of which is recycled via pipeline 11 and mixed with the supplementary coke-pulling feedstock from the pipeline 13 to return to the coke tower 4*a;*

(8) Performing steam purging and decoking on the coke tower 4*c* to be on standby; and (9) Repeating steps (3) to (8).

Figure 2:
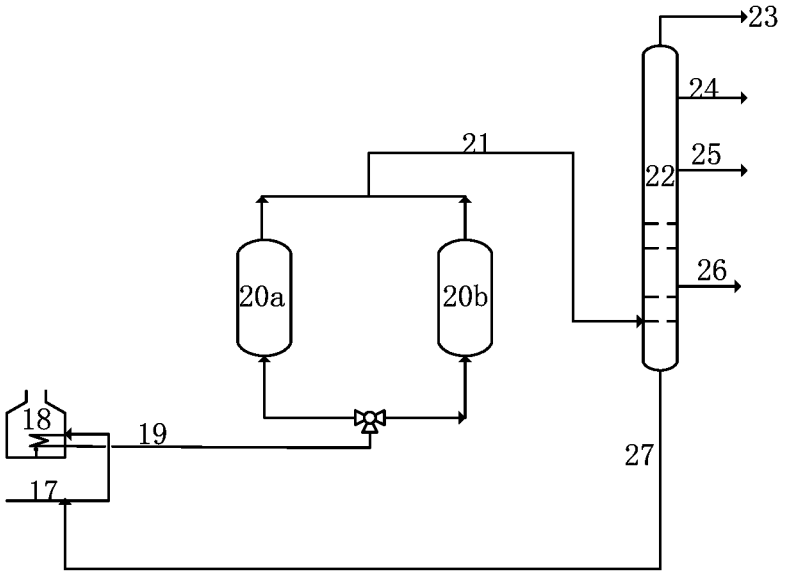
Prior Art FIG. 2
FIG. 2 is a coking system of one-furnace and two-tower switching according to the prior art.

As shown in FIG. 2, a fresh feedstock for needle coke 17 is heated by a heating furnace 18 and then enters a coke tower 20 via pipeline 19, the generated oil gas enters a fractionation tower 22 via pipeline 21, and is separated to produce coker gas, naphtha, coker diesel and coker gas oil respectively, which leave the fractionation tower for further treatment via pipelines 23, 24, 25 and 26. The recycled coker gas oil enters the coke tower 20 via pipeline 27, and the needle coke product leave the coke tower from the bottom of the tower for the further treatment. The coke towers 20*a* and 20*b* are operated in an intermittent switching manner, namely when the feeding amount of a coke tower reaches the maximum safe coke-charging amount, the feeding is switched to another coke tower to continue the feeding, and the first coke tower is subjected to steam purging and decoking to be on standby.

EXAMPLES

The present invention will be described in further detail below by way of examples and comparative examples, but the present invention is not limited to the following examples.

In the context of the present invention, including in the examples and comparative examples, the coefficient of thermal expansion was determined according to International Standard GB/T3074.4 "Determination of Coefficient of Thermal Expansion (CTE) for Graphite Electrodes", the volatile was determined according to Petrochemical Standard SH/T0313 "Petroleum Coke Test Method", the true density was determined according to International Standard GB/T6155 "Determination of True Density of Carbon Material", the resistivity was determined according to GB24525-2009

"Determination of Resistivity of Carbon Material", and the streamlined texture in the appearance of the needle coke was directly evaluated by naked eyes.

Example 1

Catalytic slurry oil from a refinery was used as the coking feedstock. The specific analysis properties of the slurry oil were shown in Table 1. The top pressure of the coke tower was 0.5 MPa, and the coke-producing cycle of the coking procedure was 32 h. The three-tower switching process provided by the invention was performed. In step (1), the outlet temperature of the heating furnace 1 was 420-440° C., where a procedure of rising the temperature and maintaining the temperature was performed, the heating rate was 5° C./h, and the temperature-maintaining time was 12 h, and the gas velocity in the coke tower was controlled to 0.05-0.08 m/s. In step (2), the outlet temperature of the heating furnace 2 was 460-490° C., where a procedure of rising the temperature and maintaining the temperature was performed, the heating rate was 10° C./h, and the temperature-maintaining time was 13 h, and the gas velocity in the coke tower was controlled to 0.13-0.18 m/s. In steps (1) to (5), the coker gas oil had a 10% distillate point temperature of 350° C. and a 90% distillate point temperature of 460° C. In the coke-charging process with the coking-pulling feedstock to the coke tower, the pulling/forming ratio (the ratio of the coke-pulling feedstock to the coke-forming feedstock) was controlled to 1.0. The concentration of the coke fine particles in the coke-pulling feedstock was controlled to >20 mg/L. The properties of different batches of needle cokes obtained with the three-tower process were shown in Table 2.

Specifically, catalytic slurry oil from a refinery was used as the coke-forming material for producing the needle coke, the specific analysis properties of the slurry oil were shown in table 1, and its coke formation rate A was 40%. The supplementary coke-pulling feedstock was a coker gas oil (temporarily stored in a coke-pulling feedstock storage tank 12) from a separation tower 6, which had a 10% distillate point temperature of 350° C. and a 90% distillate point temperature of 460° C., and its coke formation rate B was 10%. The coke-charging cycle T of the coke tower was 32 h. The specific operations were as follows:

(1) The feedstock 1 was heated by a heating furnace 2 and fed to the coke tower 4*a* as the coke-forming feedstock. The outlet of the heating furnace 2 was controlled in a mode of variable temperature and constant temperature. The variable temperature range was 420-440° C. with a heating rate of 5° C./h. The top pressure of the coke tower 4*a* was 0.5 MPa. The oil gas generated by the coke tower 4*a* was fed to a separation tower 6 via pipeline 5. The top pressure of the separation tower 6 was 0.5 MPa, and the top temperature of the tower was 150° C., the bottom temperature of the tower was 350° C. The oil gas was separated to produce a gas 7, a gasoline 8 and a diesel 9 that left the separation tower for the further treatment, and a coker gas oil that left the separation tower from the bottom of the tower.

(2) When the feeding duration of the coke tower 4*a* reached 50% of the coke-charging cycle T of the coke tower 4*a*, the feeding of the coke-forming feedstock to the coke tower 4*a* was stopped, simultaneously the feeding of the coke-forming feedstock to the coke tower 4*b* was started and a supplementary coke-pulling feedstock in the coke-pulling feedstock storage tank 12 was fed through the filtration device 16 via pipeline 13 (where the concentration of the coke fine particles in the coke-pulling feedstock was controlled to >20 mg/L) and the heating furnace 14 (where the feedstock was heated) to the coke tower 4*a*. The outlet temperature of the heating furnace 14 was 460-490° C., where a procedure of rising the temperature and maintaining the temperature was performed and the heating rate was 10° C./h. The top pressure of the coke towers 4*a* and 4*b* was controlled to 0.5 MPa. The oil gas generated by the coke towers 4*a* and 4*b* was fed to the separation tower 6, where the top pressure of the separation tower 6 was 0.5 MPa, the top temperature of the tower was 150° C., and the bottom temperature of the tower was 350° C., and separated to produce a gas 7, a gasoline 8 and a diesel 9 that left the separation tower for the further treatment, and a coker gas oil at the bottom of the tower. According to the situation, a part of the coker gas oil was fed to the coke-pulling feedstock storage tank 12 via pipeline 10, and another part was recycled via pipeline 11 and mixed with the supplementary coke-pulling feedstock from the pipeline 13 to return to the coke tower 4*a*. The pulling/forming ratio (the ratio of the coke-pulling feedstock to the coke-forming feedstock) was controlled to 1.0.

(3) When the feeding duration of the coke tower 4*b* reached 50% of the coke-charging cycle T of the coke tower 4*b*, the feeding of the coke-forming feedstock to the coke tower 4*b* was stopped, simultaneously the feeding of the coke-forming feedstock to the coke tower 4*c* was started. The outlet of the heating furnace 2 was controlled in a mode of variable temperature and constant temperature.

The variable temperature range was 420-440° C. with a heating rate of 5° C./h. The feeding of the coke-pulling feedstock to the coke tower 4*b* was started and the feeding of the coke-pulling feedstock to the coke tower 4*a* was stopped. The outlet temperature of the heating furnace 14 was 460-490° C., where a procedure of rising the temperature and maintaining the temperature was performed and the heating rate was 10° C./h. The top pressure of the coke towers 4*b* and 4*c* was controlled to 0.5 MPa. The oil gas generated by the coke towers 4*b* and 4*c* was fed to the separation tower 6, where the top pressure of the separation tower 6 was 0.5 MPa, the top temperature of the tower was 150° C., and the bottom temperature of the tower was 350° C., and separated to produce a gas 7, a gasoline 8 and a diesel 9 that left the separation tower for the further treatment, and a coker gas oil at the bottom of the tower. According to the situation, a part of the coker gas oil was fed to the coke-pulling feedstock storage tank 12 via pipeline 10, and another part was recycled via pipeline 11 and mixed with the supplementary coke-pulling feedstock from the pipeline 13 to return to the coke tower 4*b*. The pulling/forming ratio (the ratio of the coke-pulling feedstock to the coke-forming feedstock) was controlled to 1.0.

(4) Performing steam purging and decoking on the coke tower 4*a* to be on standby;

(5) When the feeding duration of the coke tower 4*c* reached 50% of the coke-charging cycle T of the coke tower 4*c*, the feeding of the coke-forming feedstock to the coke tower 4*c* was stopped, simultaneously the feeding of the coke-forming feedstock to the coke tower 4*a* was started, the feeding of the coke-pulling feedstock to the coke tower 4*c* was started and the feeding of the coke-pulling feedstock to the coke tower 4*b* was stopped. The outlet of the heating furnace 2 was controlled in a mode of variable temperature and constant temperature. The variable temperature range was 420-440° C. with a heating rate of 5° C./h. The outlet temperature of the heating furnace 14 was 460-490° C., where a procedure of rising the temperature and maintaining the temperature was performed and the heating rate was 10° C./h. The top pressure of the coke towers 4*a* and 4*c* was controlled to 0.5 MPa. The oil gas generated by the coke towers 4*a* and 4*c* was fed to the separation tower 6, where the top pressure of the separation tower 6 was 0.5 MPa, the top temperature of the tower was 150° C., and the bottom temperature of the tower was 350° C., and separated to produce a gas 7, a gasoline 8 and a diesel 9 that left the separation tower for the further treatment, and a coker gas oil at the bottom of the tower. According to the situation, a part of the coker gas oil was fed to the coke-pulling feedstock storage tank 12 via pipeline 10, and another part was recycled via pipeline 11 and mixed with the supplementary coke-pulling feedstock from the pipeline 13 to return to the coke tower 4*c*. The pulling/forming ratio (the ratio of the coke-pulling feedstock to the coke-forming feedstock) was controlled to 1.0.

(6) Performing steam purging and decoking on the coke tower 4*b* to be on standby.

(7) When the feeding duration of the coke tower 4*a* reached 50% of the coke-charging cycle T of the coke tower 4*a*, the feeding of the coke-forming feedstock to the coke tower 4*a* was stopped, simultaneously the feeding of the coke-forming feedstock to the coke tower 4*b* was started, the feeding of the coke-pulling feedstock to the coke tower 4*a* was started and the feeding of the coke-pulling feedstock to the coke tower 4*c* was stopped. The outlet of the heating furnace 2 was controlled in a mode of variable temperature and constant temperature. The variable temperature range was 420-440° C. with a heating rate of 5° C./h. The outlet temperature of the heating furnace 14 was 460-490° C., where a procedure of rising the temperature and maintaining the temperature was performed and the heating rate was 10° C./h. The top pressure of the coke towers 4*a* and 4*b* was controlled to 0.5 MPa. The oil gas generated by the coke towers 4*a* and 4*b* was fed to the separation tower 6, where the top pressure of the separation tower 6 was 0.5 MPa, the top temperature of the tower was 150° C., and the bottom temperature of the tower was 350° C., and separated to produce a gas 7, a gasoline 8 and a diesel 9 that left the separation tower for the further treatment, and a coker gas oil at the bottom of the tower. According to the situation, a part of the coker gas oil was fed to the coke-pulling feedstock storage tank 12 via pipeline 10, and another part was recycled via pipeline 11 and mixed with the supplementary coke-pulling feedstock from the pipeline 13 to return to the coke tower 4*a*.

(8) Performing steam purging and decoking on the coke tower 4*c* to be on standby; and (9) Repeating the steps (3) to (8) and starting the stable production of the needle coke.

The properties of different batches of needle cokes obtained with the three-tower process were shown in Table 2.

Comparative Example 1

The same coke-forming feedstock as in example 1 was used. The coke-charging cycle T was 32 hours. The conventional two-tower switching operation shown in FIG. 2 was performed. A fresh feedstock for needle coke 17 was heated by a heating furnace 18 and then enters a coke tower 20 via pipeline 19. The outlet of the heating furnace 18 was controlled in a mode of variable temperature and constant temperature. The variable temperature range was 420-440° C. with a heating rate of 5° C./h. The top pressure of the coke tower 20 was 0.5 MPa.

The generated oil gas was fed via pipeline 21 to a fractionation tower 22, where the top pressure of the fractionation tower 22 was 0.5 MPa, the top temperature of the tower was 150° C., and the bottom temperature of the tower was 350° C., and separated to produce coker gas, naphtha, coker diesel and coker gas oil respectively, which left the fractionation tower for further treatment via pipelines 23, 24, 25 and 26. The recycled coker gas oil was fed via pipeline 27 to the coke tower 20.

The pulling/forming ratio (the ratio of the coke-pulling feedstock to the coke-forming feedstock) was 1.0. When the feeding duration of the coke tower reached 50% of the coke-charging cycle T of the coke tower, the outlet temperature of the heating furnace 18 increased to 500° C. at a temperature rising rate of 5° C./h from the starting temperature of 440° C. When the feeding duration of the coke tower reached 100% of the coke-charging cycle T of the coke tower, the feeding was switched to another coke tower to start the coke-charging. The above process was repeated. The needle coke product was discharged from the bottom of the coke tower. The properties of different batches of the obtained needle cokes were shown in Table 2.

TABLE 1

| Feedstock Properties | |
|---|---|
| Analysis items | Catalytic slurry oil |
| Density g/cm$^3$ | 1.0758 |
| Ash % | 0.01 |
| C % (w) | 90.08 |
| H % (w) | 7.69 |
| S % (w) | 0.21 |
| N ppm | 1800 |

TABLE 1-continued

| Feedstock Properties | |
|---|---|
| Analysis items | Catalytic slurry oil |
| SARA % (w) | |
| Saturates | 17.67 |
| Aromatics | 75.96 |
| Resins | 6.34 |
| Asphaltenes | 0.04 |
| Metal Content, ppm | |
| Ni | 3.39 |
| V | 2.96 |

TABLE 2

Properties of needle coke produced in Example 1 and Comparative example 1

| | Example 1 | | | Comparative Example 1 | | |
|---|---|---|---|---|---|---|
| Analysis Item | Batch 1 | Batch 2 | Batch 3 | Batch 1 | Batch 2 | Batch 3 |
| Coefficient of thermal expansion, $10^{-6}$/° C. | 1.0 | 1.1 | 1.0 | 1.2 | 1.6 | 1.9 |
| Volatile, w % | 8.5 | 8.2 | 8.5 | 9.8 | 9.5 | 8.8 |
| Resistivity, μΩ • m | 7.8 | 7.0 | 7.6 | 8.0 | 10.5 | 14.5 |
| True density, g/cm$^3$ | 2.12 | 2.12 | 2.12 | 2.10 | 2.12 | 2.09 |
| Streamlined texture in the appearance | Obvious | Obvious | Obvious | Obvious | Not obvious | Not obvious |

Example 2

The same apparatus and coke-forming feedstock for producing needle coke as in example 1 were used. The supplementary coke-pulling feedstock was a coker gas oil (temporarily stored in a coke-pulling feedstock storage tank 12) from a separation tower 6 having a 10% distillate point temperature of 330° C. and a 90% distillate point temperature of 480° C., and its coke formation rate B is 20%. The coke-charging cycle T of the coke tower was 40 h. The top pressure of the coke tower was 0.8 MPa. The outlet temperature of the heating furnace 2 was 400-460° C., where a procedure of rising the temperature and maintaining the temperature was performed, the heating rate was 4° C./h. In the coking-charging process with the heating furnace 2 to the coke tower, the gas velocity in the coke tower was controlled to 0.07-0.10 m/s. The outlet temperature of the heating furnace 14 was 470-510° C., and the heating rate was 10° C./h. In the coking-charging process with the heating furnace 14 to the coke tower, the gas velocity in the coke tower was controlled to 0.18-0.25 m/s. In the coke-charging process with the coke-pulling feedstock (such as coker gas oil) to the coke tower, the pulling/forming ratio (the ratio of the coke-pulling feedstock to the coke-forming feedstock) was controlled to 2.0. The concentration of the coke fine particles in the coke-pulling feedstock was controlled to >10 mg/L. The top pressure of the fractionation tower was 0.2 MPa, the top temperature of the tower was 100° C., and the bottom temperature of the tower is 330° C. Other conditions were the same as in Example 1. The properties of different batches of needle cokes obtained with the three-tower process were shown in Table 3.

Comparative Example 2

The same coke-forming feedstock as that in the Example 2 was used. The coke-charging cycle T was 40 h. The outlet of the heating furnace 18 was controlled in a mode of variable temperature and constant temperature, and the variable temperature range was 420-460° C. with a heating rate of 4° C./h. The top pressure of the coke tower 20 was 0.8 MPa. The top pressure of the fractionation tower was 0.2 MPa, and the top temperature of the tower was 100° C., the bottom temperature of the tower was 330° C. The pulling/forming ratio (the ratio of the coke-pulling feedstock to the coke-forming feedstock) was 0.5. When the feeding duration of the coke tower reached 50% of the coke-charging cycle T of the coke tower, the outlet temperature of the heating furnace 18 increased to 500° C. at a temperature rising rate of 4° C./h from the starting temperature of 460° C. Other conditions were the same as in Comparative example 1. The properties of different batches of the obtained needle cokes were shown in Table 3.

TABLE 3

Properties of needle coke produced in Example 2 and Comparative example 2

| | Example 2 | | | Comparative Example 2 | | |
|---|---|---|---|---|---|---|
| Analysis Item | Batch 1 | Batch 2 | Batch 3 | Batch 1 | Batch 2 | Batch 3 |
| coefficient of thermal expansion, $10^{-6}$/° C. | 1.1 | 1.0 | 1.0 | 1.4 | 1.9 | 1.5 |
| Volatile, w % | 8.8 | 8.6 | 8.8 | 9.6 | 10.5 | 12.3 |
| Resistivity, Ω • m | 7.0 | 7.2 | 7.0 | 9.5 | 16.3 | 15.4 |
| True density, g/cm$^3$ | 2.12 | 2.12 | 2.12 | 2.12 | 2.08 | 2.12 |
| Streamlined texture in the appearance | Obvious | Obvious | Obvious | Not obvious | Not obvious | Not obvious |

The invention claimed is:

1. A coking process to produce needle coke by using a system comprising heating units a and b, and coke towers a, b, and c, wherein each heating unit is connected to each coke tower, at least one of the coke towers has a coke-charging starting time (TO) and a coke-charging termination time (Te), a top of each coke tower is in fluid communication with a separation tower, the heating unit a heats only a coke-forming feedstock, and the heating unit b heats only a coke-pulling feedstock, the coking process comprises at least steps of:

S1: feeding the coke-forming feedstock into the coke tower a, and introducing an oil gas generated by the coke tower a into the separation tower;

S2: when a feeding duration of the coke tower a reaches 30-70% of a coke-charging cycle T of the coke tower a, stopping feeding the coke-forming feedstock to the coke tower a, simultaneously starting to feed the coke-forming feedstock to the coke tower b and starting to feed the coke-pulling feedstock to the coke tower a, and feeding an oil gas generated by the coke tower b to the separation tower;

S3: when a feeding duration of the coke tower b reaches 30-70% of a coke-charging cycle T of the coke tower b, stopping feeding the coke-forming feedstock to the coke tower b, simultaneously starting to feed the coke-forming feedstock to the coke tower c, starting to feed the coke-pulling feedstock to the coke tower b, and stopping feeding the coke-pulling feedstock to the coke tower a, and feeding an oil gas generated by the coke tower c;

S4: performing steam purging and decoking operations on the coke tower a;

S5: when a feeding duration of the coke tower c reaches 30-70% of a coke-charging cycle T of the coke tower c, stopping feeding the coke-forming feedstock to the coke tower c, simultaneously starting to feed the coke-forming feedstock to the coke tower a, starting to feed the coke-pulling feedstock to the coke tower c and stopping feeding the coke-pulling feedstock to the coke tower b, and feeding the oil gas generated by the coke tower a to the separation tower;

S6: performing steam purging and decoking operations on the coke tower b;

S7: when the feeding duration of the coke tower a reaches 30-70% of the coke-charging cycle T of the coke tower a, stopping feeding the coke-forming feedstock to the coke tower a, and simultaneously starting to feed the coke-forming feedstock to the coke tower b, starting to feed the coke-pulling feedstock to the coke tower a and stopping feeding the coke-pulling feedstock to the coke tower c, and feeding the oil gas generated by the coke tower b to the separation tower; and S8: performing steam purging and decoking operations on the coke tower c, wherein the separation tower continuously receives the oil gas from one of the coke towers a, b, or c, and outputs a coker gas oil, and wherein the coke-forming feedstock has a coke formation rate of 30 to 60%, and the coke-pulling feedstock is the coker gas oil and has a coke formation rate of 1-10%.

2. The coking process of claim 1, wherein during a single material transport cycle, each of the heating unit a and the heating unit b transports a single batch of material to one of the coke towers.

3. The coking process of claim 1, further comprising purging and decoking any of the coke towers before putting it on standby.

4. The coking process of claim 1, wherein:

in S1, the heating unit a heats the coke-forming feedstock to a feeding temperature of from 400° C. to 480° C. and the coke-forming feedstock brings an intra-tower gas velocity of the coke tower a to 0.05 to 0.25 m/s, and in S2, the heating unit b heats the coke-pulling feedstock to a feeding temperature of from 460° C. to 530° C. and brings the intra-tower gas velocity of the coke tower a to 0.10 to 0.30 m/s.

5. The coking process of claim 1, wherein the separation towers is selected from a group consisting of a rectifying tower, a flash tower, an evaporation tower, and a fractionation tower.

6. The coking process of claim 1, the separation tower is operated at a top pressure of 0.01-0.8 MPa, a top temperature of 100-200° C., and a bottom temperature of 280-400° C., and/or the coke towers are operated under identical to or different conditions ranging from a top pressure of 0.01-1.0 MPa, a top temperature of 300-470° C., and a bottom temperature of 350-510° C.

7. The coking process of claim 1, wherein a weight ratio of a total amount of the coke-pulling feedstock to a total amount of the coke-forming feedstock transported to the coke tower a during the steps of S1 to S8 is from 0.5 to 4.0.

8. The coking process of claim 1, wherein a coke-charging cycle time equals a difference between Te and TO, and is 10 to 60 hours for each coke tower, or each coke tower has a same coke-charging cycle time or different coke-charging cycle times cycles T in the range of 10 to 60 hours.

9. The coking process of claim 1, further comprising filtering the coke-forming feedstock or the coke-pulling feedstock so that a coke fine particle concentration thereof a range of 0 to 200 mg/L.

10. The coking process of claim 1, wherein 50 wt % or more of the oil gas from each coke tower is transferred to the separation tower.

11. The coking process of claim 4, wherein:

in S1, the heating unit a heats the coke-forming feedstock to the feeding temperature of from 420° C. to 460° C. and the coke-forming feedstock brings the intra-tower gas velocity G1 of the h-th coke tower to from 0.05 to 0.10 m/s, and in S2, the heating unit b heats the coke-pulling feedstock to the feeding temperature of from 460° C. to 500° C. and the coke-pulling feedstock brings the intra-tower gas velocity Gm of the h-th coke tower to from 0.15 to 0.20 m.

12. The coking process of claim 1, wherein the coke-forming feedstock has a sulfur content <0.5 wt %, and a colloid/asphaltene content <2.0 wt %.

13. The coking process of claim 1, wherein the coke-forming feedstock is selected from at least one of coal tar, coal tar pitch, petroleum heavy oil, ethylene tar, catalytic cracking residue, and thermal cracking residue.

14. The coking process of claim 1, wherein the coke-pulling feedstock has a sulfur content <0.6 wt %.

15. The coking process of claim 7, wherein the weight ratio of the total amount of the coke-pulling feedstock to the total amount of the coke-forming feedstock transported to the coke tower during the steps of S1 to S8 is from 1.0 to 2.0.

16. The coking process of claim 1, wherein the heating unit a has a heating rate of 1-10° C./h and the heating unit b has a heating rate of 50-100° C./h.

* * * * *